US008490707B2

(12) United States Patent
Robisson et al.

(10) Patent No.: US 8,490,707 B2
(45) Date of Patent: Jul. 23, 2013

(54) OILFIELD APPARATUS AND METHOD COMPRISING SWELLABLE ELASTOMERS

(75) Inventors: Agathe Robisson, Cambridge, MA (US); Francois Auzerais, Boston, MA (US); Sudeep Maheshwari, Cambridge, MA (US); Kuo-Chiang Chen, Sugar Land, TX (US); Partha Ganguly, Sugar Land, TX (US); Nitin Vaidya, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 261 days.

(21) Appl. No.: 13/004,442

(22) Filed: Jan. 11, 2011

(65) Prior Publication Data

US 2012/0175134 A1 Jul. 12, 2012

(51) Int. Cl.
*E21B 33/12* (2006.01)

(52) U.S. Cl.
USPC ..... 166/387; 166/187

(58) Field of Classification Search
USPC ..... 166/387, 179, 187
See application file for complete search history.

(56) References Cited

U.S. PATENT DOCUMENTS

| | | | |
|---|---|---|---|
| 3,385,367 | A | 5/1968 | Kollsman |
| 4,936,386 | A | 6/1990 | Colangelo |
| 5,159,980 | A | 11/1992 | Onan et al. |
| 5,293,938 | A | 3/1994 | Onan et al. |
| 5,738,463 | A | 4/1998 | Onan |
| 6,007,912 | A | 12/1999 | Doujak |
| 6,082,456 | A | 7/2000 | Dahl-Joergensen et al. |
| 6,156,822 | A | 12/2000 | Materne et al. |
| 6,196,316 | B1 | 3/2001 | Bosma et al. |
| 6,448,325 | B2 | 9/2002 | Visel et al. |
| 6,649,678 | B1 | 11/2003 | Sandstrom |
| 6,737,478 | B2 | 5/2004 | Obrecht et al. |
| 6,742,592 | B1 | 6/2004 | Le Roy-Delage et al. |
| 6,766,858 | B2 | 7/2004 | Nguyen et al. |
| 6,769,491 | B2 | 8/2004 | Zimmerman et al. |
| 6,907,929 | B2 | 6/2005 | Leroy-Delage et al. |
| 6,929,857 | B2 | 8/2005 | Watanabe et al. |
| 6,960,394 | B2 | 11/2005 | Graham et al. |
| 7,007,755 | B2 | 3/2006 | Reddy et al. |
| 7,059,415 | B2 | 6/2006 | Bosma et al. |
| 7,119,150 | B2 | 10/2006 | Lin et al. |
| 7,143,832 | B2 | 12/2006 | Freyer |

(Continued)

FOREIGN PATENT DOCUMENTS

| | | |
|---|---|---|
| EP | 1649136 | 10/2006 |
| EP | 1672166 | 11/2007 |

(Continued)

OTHER PUBLICATIONS

International Search Report and Written Opinion of PCT Application No. PCT/US2010/051788 dated Jul. 29, 2011: pp. 1-8.

(Continued)

*Primary Examiner* — William P Neuder
(74) *Attorney, Agent, or Firm* — Bridget Laffey; Rachel E. Greene; Jakub Michna

(57) ABSTRACT

The subject disclosure relates to apparatus and methods that are particularly suited for creating a seal in a borehole annulus. More particularly, the subject disclosure relates to a seal with enhanced sealing capability. In one embodiment the subject disclosure relates to a reinforced and permanent swellable packer device.

38 Claims, 10 Drawing Sheets

U.S. PATENT DOCUMENTS

| | | | |
|---|---|---|---|
| 7,156,137 | B2 | 1/2007 | Corvasce et al. |
| 7,160,949 | B2 | 1/2007 | Ota et al. |
| 7,228,915 | B2 | 6/2007 | Thomson |
| 7,247,666 | B2 | 7/2007 | Urabe et al. |
| 7,247,669 | B2 | 7/2007 | Sandstrom |
| 7,252,142 | B2 | 8/2007 | Brezinski et al. |
| 7,287,586 | B2 | 10/2007 | Everett et al. |
| 7,307,121 | B2 | 12/2007 | Zhang et al. |
| 7,320,367 | B2 | 1/2008 | Brezinski et al. |
| 7,338,998 | B2 | 3/2008 | Kondo |
| 7,342,065 | B2 | 3/2008 | Yang et al. |
| 7,351,279 | B2 | 4/2008 | Brothers |
| 7,373,991 | B2 | 5/2008 | Vaidya et al. |
| 7,393,564 | B2 | 7/2008 | Hergenrother et al. |
| 7,402,204 | B2 | 7/2008 | Le Roy-Delage et al. |
| 7,404,437 | B2 | 7/2008 | Brezinski et al. |
| 7,488,705 | B2 | 2/2009 | Reddy et al. |
| 7,520,327 | B2 | 4/2009 | Surjaatmadja |
| 7,527,099 | B2 | 5/2009 | Bosma et al. |
| 7,528,186 | B2 | 5/2009 | Halasa et al. |
| 7,578,347 | B2 | 8/2009 | Bosma et al. |
| 7,578,354 | B2 | 8/2009 | Thomson |
| 7,607,482 | B2 | 10/2009 | Roddy et al. |
| 7,607,484 | B2 | 10/2009 | Roddy et al. |
| 7,631,697 | B2 | 12/2009 | Bhavsar |
| 7,647,970 | B2 | 1/2010 | Mueller et al. |
| 7,658,387 | B2 | 2/2010 | Park |
| 7,665,537 | B2 | 2/2010 | Patel et al. |
| 7,740,067 | B2 | 6/2010 | Bour et al. |
| 7,964,656 | B2 | 6/2011 | Boehm et al. |
| 2001/0009890 | A1 | 7/2001 | Patel et al. |
| 2005/0003967 | A1 | 1/2005 | Rea et al. |
| 2005/0039917 | A1 | 2/2005 | Hailey, Jr. |
| 2005/0065266 | A1 | 3/2005 | Yang et al. |
| 2005/0096412 | A1 | 5/2005 | Petr et al. |
| 2005/0109502 | A1 | 5/2005 | Buc Slay et al. |
| 2005/0171248 | A1 | 8/2005 | Li et al. |
| 2005/0186409 | A1 | 8/2005 | Graham et al. |
| 2005/0199401 | A1 | 9/2005 | Patel et al. |
| 2006/0169455 | A1 | 8/2006 | Everett et al. |
| 2006/0196126 | A1 | 9/2006 | De Neef |
| 2006/0290070 | A1 | 12/2006 | Park |
| 2007/0010606 | A1 | 1/2007 | Hergenrother et al. |
| 2007/0022915 | A1 | 2/2007 | Drochon et al. |
| 2007/0037917 | A1 | 2/2007 | Sandstrom |
| 2007/0039160 | A1 | 2/2007 | Turley et al. |
| 2007/0056735 | A1 | 3/2007 | Bosma et al. |
| 2007/0135533 | A1 | 6/2007 | Bohm et al. |
| 2007/0142531 | A1 | 6/2007 | Sugimoto |
| 2007/0187146 | A1 | 8/2007 | Wylie et al. |
| 2008/0000646 | A1 | 1/2008 | Thomson |
| 2008/0027162 | A1 | 1/2008 | Hua et al. |
| 2008/0060820 | A1 | 3/2008 | Bour et al. |
| 2008/0078561 | A1 | 4/2008 | Chalker et al. |
| 2008/0099203 | A1 | 5/2008 | Mueller et al. |
| 2008/0121327 | A1 | 5/2008 | Matsumura et al. |
| 2008/0125335 | A1 | 5/2008 | Bhavsar |
| 2008/0135250 | A1 | 6/2008 | Bosma et al. |
| 2008/0289824 | A1 | 11/2008 | Burts, Jr. et al. |
| 2009/0029878 | A1 | 1/2009 | Bicerano |
| 2009/0038796 | A1* | 2/2009 | King ..... 166/277 |
| 2009/0038800 | A1 | 2/2009 | Ravi et al. |
| 2009/0071650 | A1 | 3/2009 | Roddy et al. |
| 2009/0084550 | A1 | 4/2009 | Korte et al. |
| 2009/0088348 | A1 | 4/2009 | Roddy et al. |
| 2009/0107677 | A1 | 4/2009 | James et al. |
| 2009/0114450 | A1 | 5/2009 | Watkins et al. |
| 2010/0252254 | A1 | 10/2010 | Nutley et al. |
| 2011/0086942 | A1* | 4/2011 | Robisson et al. ..... 523/130 |
| 2011/0098202 | A1 | 4/2011 | James et al. |
| 2011/0253393 | A1 | 10/2011 | Vaidya et al. |

FOREIGN PATENT DOCUMENTS

| | | |
|---|---|---|
| JP | 61034087 | 2/1986 |
| JP | 62109883 | 5/1987 |
| JP | 2006118130 | 5/2006 |
| WO | 2005012686 | 2/2005 |
| WO | 2007126318 | 11/2007 |
| WO | 2009015725 | 2/2009 |

OTHER PUBLICATIONS

International Search Report and Written Opinion of PCT Application No. PCT/US2012/020952 dated Aug. 30, 2012: pp. 1-11.

Edwards, "Review Polymer-filler interactions in rubber reinforcement," Journal of Materials Science, 1990, vol. 25: pp. 4175-4185.

Endres, "Factors Determining the Reinforcing Value of Fillers in Compound Rubber," Industrial and Engineering Chemistry, Nov. 1924, vol. 16(11): pp. 1148-1152.

Heidberg et al., "Ceramic hydration with expansion. The structure and reaction of water layers on magnesium oxide. A cyclic cluster study," Materials Science—Poland, 2005, vol. 23(2): pp. 501-508.

Krysztafkiewicz et al., "Reinforcing of synthetic rubber with waste cement dust modified by coupling agents," J. Adhesion Sci. Technol., 1997, vol. 11(4): pp. 507-517.

Onan et al., "SPE 26572: Elastomeric Composites for Use in Well Cementing Operations," SPE International, 1993: pp. 593-608.

Rattanasom et al., "Reinforcement of natural rubber with silica/carbon black hybrid filler," Polymer Testing, 2007, vol. 26: pp. 369-377.

Wang, "Effect of Polymer-Filler and Filler-Filler Interactions on Dynamic Properties of Filled Vulcanizates," Rubber Chemistry and Technology/Rubber Reviews, Jul.-Aug. 1998, vol. 71(3): pp. 520-589.

* cited by examiner

OILFIELD APPARATUS AND METHOD COMPRISING SWELLABLE ELASTOMERS

FIELD OF THE DISCLOSURE

The subject disclosure relates generally to the field of oilfield exploration, production, and testing, and more specifically to swellable elastomeric materials and their uses in such ventures.

BACKGROUND OF THE DISCLOSURE

Hydrocarbon fluids such as oil and natural gas are obtained from a subterranean geological formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Well pipe such as coiled or threaded production tubing, for example, is surrounded by an annular space between the exterior wall of the tubing and the interior wall of the casing or borehole wall. Frequently, it is necessary to seal this annular space between upper and lower portions of the well depth. It is often desired to utilize packers to form an annular seal in wellbores. Open-hole packers provide an annular seal between the earthen sidewall of the wellbore and a tubular. Cased-hole packers provide an annular seal between an outer tubular and an inner tubular. The sealing element of a packer is a ring of rubber or other elastomer that is secured and sealed to the interior wall surface which may be the interior casing wall or the borehole wall. By compression, for example, the ring of rubber is expanded radially against the casing or borehole wall.

Common types of packers include inflatable packers, mechanical expandable packers, and swell packers. Inflatable packers typically carry a bladder that may be pressurized to expand outwardly to form the annular seal. Mechanical expandable packers have a flexible material expanding against the outer casing or wall of the formation when compressed in the axial direction of the well. Swell packers comprise a sealing material that increases in volume and expands radially outward when a particular fluid contacts and diffuses into the sealing material in the well. For example the sealing material may swell in response to exposure to a hydrocarbon fluid or to exposure to water in the well. The sealing material may be constructed of a rubber compound or other suitable swellable material.

The benefits of using swellable seal materials in well packers are well known. For example, typical swellable seal materials can conform to irregular well surfaces and can expand radially outward without the use of complex and potentially failure-prone downhole mechanisms. Swell packers are isolation tools that utilize elastomer swelling to provide a barrier in casing/open hole and casing/tubing annuli. These packers may have a water reactive section, an oil reactive section or both. A water reactive section may consist of water-absorbing particles incorporated into a polymer. These particles swell by absorbing water, which in turn expands the rubber. An oil reactive section may utilize oleophilic polymers that absorbs hydrocarbons into the matrix. This process may be a physical uptake of the hydrocarbons which swells, lubricates and decreases the mechanical strength of the material as it expands, limiting the maximum differential pressure that can be applied across the packer. Moreover, the material deswells in the absence of a triggering fluid resulting in a loss of the annular seal upon changes to the wellbore fluid environment.

It would be an advance in the art if the elastomers used in swellable seals could be improved that when swollen are mechanically stronger and more durable. Further, it would be an advance in the art if the elastomer did not deswell in the absence of the triggering fluid.

The presently disclosed subject matter addresses the problems of the prior art by reinforcing the elastomeric composition. The presently disclosed subject matter discloses elastomer compositions that swell and stiffen but do not substantially degrade or disintegrate upon long term exposure to particular fluids.

SUMMARY OF THE DISCLOSURE

In view of the above there is a need for an improved mechanism for sealing applications. Further there is a need for an improved mechanism to reinforce the seal after swelling or setting. Finally, there is a need for the seal to remain swollen in the absence of the triggering fluid and not fully deswell. The subject technology accomplishes these and other objectives. The subject disclosure relates to a swellable downhole device, useful for downhole sealing. In non-limiting, examples, the swellable downhole device is useful for mechanical packers, swell packers or in certain situations may be used as a cement replacement. The swellable device comprises material which swells in response to a triggering fluid. The mechanism of swelling is via a chemical reaction between the reactive filler and the triggering fluid. Other triggering mechanisms may also be used, in non-limiting examples, temperature, pH or time. As used herein the term "reactive filler" is defined as a filler that undergoes a chemical reaction with the triggering fluid or another triggering mechanism. Additionally, the swellable device comprises a material that increases in volume after being triggered and also becomes less compliant.

In accordance with an embodiment of the subject disclosure a sealing system for use in a subterranean wellbore is disclosed. The sealing system comprises a seal assembly. The seal assembly comprises a base polymer and one or a plurality of reactive fillers combined with the base polymer. The seal assembly is compliant before contacting a triggering fluid and increases from a first volume to a second volume and becomes less compliant in response to contact with the triggering fluid.

In accordance with a further embodiment of the subject disclosure, a method for forming a seal in a wellbore is disclosed. The method comprises a step of providing a composition comprising a reactive filler and a base material. The method further comprises the step of deploying the composition into the wellbore and exposing the composition to a triggering fluid, thereby forming a seal in the wellbore. The formed seal isolates a particular wellbore zone from another wellbore zone or region of a subterranean formation. In non-limiting examples, the seal formed is an o-ring, a packer element, a flow control valve or a bridge plug.

In accordance with a further embodiment of the subject disclosure, a sealing system for use in a subterranean wellbore is disclosed. The sealing system comprises a swellable material. This swellable material comprises a base polymer and a reinforcing reactive filler disposed in the base polymer. The swellable material swells when in contact with a triggering fluid and is a compliant material having a first volume before swelling with the triggering fluid and is a less compliant material having a second volume after swelling with the triggering fluid.

In accordance with a further embodiment of the subject disclosure, a method of forming an annular barrier in a subterranean wellbore is disclosed. The method comprises a number of steps. The first step is the step of compounding a reactive material within a base polymer to thereby form a compliant seal assembly. The formed compliant seal assembly contacts a triggering fluid and increases from a first volume to a second volume and becomes less compliant in response to contact with a triggering fluid. Further, the compliant seal does not decrease to the first volume in response to termination of contact with the triggering fluid.

In accordance with a further embodiment of the subject disclosure, a method of constructing a well packer is disclosed. The method comprises a number of steps. The first step involves compounding a reactive material within a base polymer to thereby form a compliant well packer. The second step involves installing the compliant well packer on a base pipe. The third step involves the compliant well packer contacting a triggering fluid and increasing from a first volume to a second volume and becoming less compliant in response to contact with a triggering fluid. Finally, the compliant well packer does not decrease to the first volume in response to termination of contact with the triggering fluid.

Further features and advantages of the subject disclosure will become more readily apparent from the following detailed description when taken in conjunction with the accompanying drawings.

DETAILED DESCRIPTION

Embodiments herein are described with reference to certain types of downhole swellable fixtures. For example, these embodiments focus on the use of packers for isolating certain downhole regions in conjunction with the use of production tubing, strings, casing or liners. Further, embodiments disclosed herein may be used as an isolating material in conjunction with a production tubing, strings, casings, liners, sand-control screens, gravel pack assembly or casing hangers inside a casing or against a formation.

However, a variety of alternative applications may employ such swell packers, such as for well stimulation, completions or isolation for water injection. Additionally, alternative swellable fixture types, such as plugs, chokes, flow control valves and restrictors may take advantage of materials and techniques disclosed herein. Finally, these swellable fixtures may be used as an annular seal as an alternative to cement, in one non-limiting example, a re-entry well. Regardless, embodiments of downhole swellable fixtures disclosed herein are configured to have both reinforcement properties and a volume increase upon exposure to fluid in a wellbore.

Reinforced elastomeric compositions are described in the following co-owned patent application, which is incorporated herein by reference in its entirety: "Reinforced Elastomers," U.S. patent application Ser. No. 12/577,121, filed, Oct. 9, 2009, and may be utilized in the construction of embodiments of downhole swellable fixtures disclosed herein.

The subject disclosure describes apparatus comprising an elastomeric material useful in oilfield applications, including hydrocarbon exploration, drilling, testing, completion, and production activities. As used herein the term "oilfield" includes land based (surface and sub-surface) and sub-seabed applications, and in certain instances seawater applications, such as when hydrocarbon exploration, drilling, testing or production equipment is deployed through seawater. The term "oilfield" as used herein includes hydrocarbon oil and gas reservoirs, and formations or portions of formations where hydrocarbon oil and gas are expected but may ultimately only contain water, brine, or some other composition. A typical use of the apparatus comprising an elastomeric component will be in downhole applications, such as zonal isolation of wellbores, although the invention is not so limited. A "wellbore" may be any type of well, including, but not limited to, a producing well, a non-producing well, an injection well, a fluid disposal well, an experimental well, an exploratory well, and the like. Wellbores may be vertical, horizontal, deviated some angle between vertical and horizontal, and combinations thereof, for example a vertical well with a non-vertical component. The use of the term "wellbore fluid" is intended to encompass completion fluids and reservoir fluids.

Figure 1:
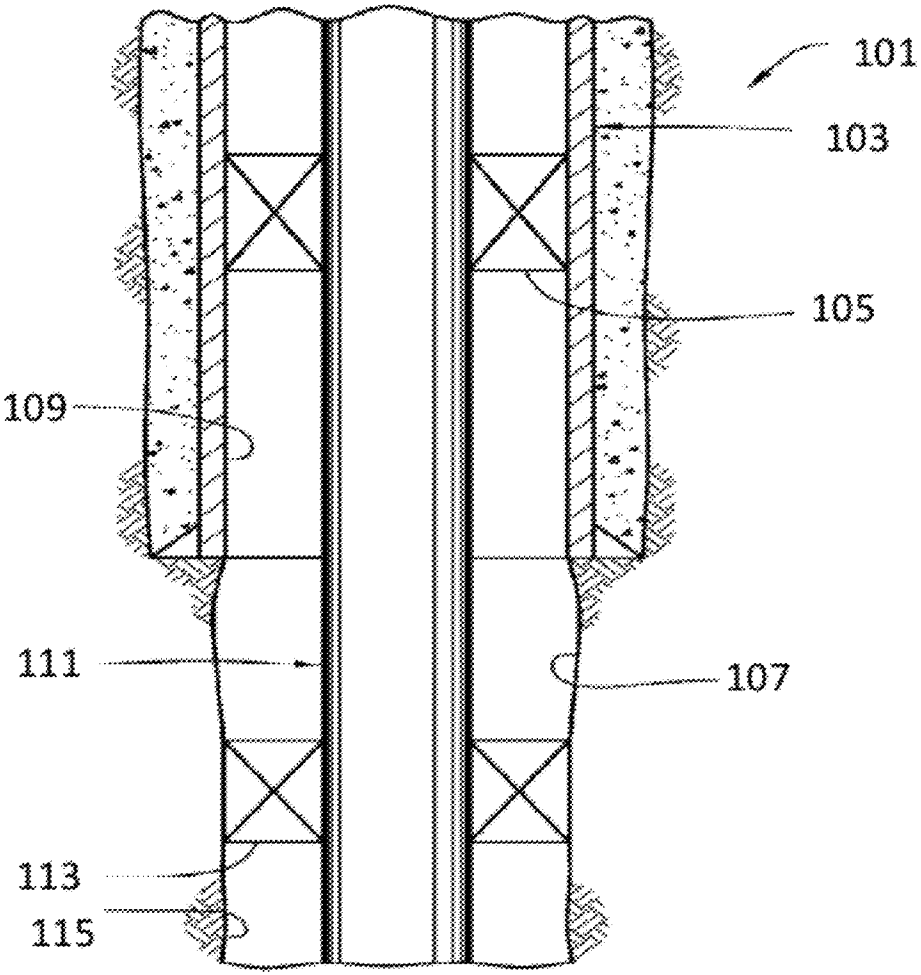
FIG. 1 is a schematic of a well system embodying principles of the present invention.

Representatively illustrated in FIG. 1 is a well system 101 which embodies principles of the subject disclosure. In the well system 101, a tubular string 111 (such as a production tubing string, liner string, etc) has been installed in a wellbore 107. The wellbore 107 may be fully or partially cased as depicted in FIG. 1, with casing string 103 in the upper portion and uncased in the lower portion. An annular barrier is formed between the tubular string 111 and the casing string 103 by means of a swell packer 105. Another annular barrier is formed between the tubular string 111 and the uncased wellbore 107 by means of another swell packer 113. The swell packer 113 swells from an unexpanded state to an expanded state when it comes into contact or absorbs a triggering fluid. The triggering fluid can be present naturally in the wellbore, can be present in the formation and then produced into the wellbore, or can be deployed or injected into the wellbore. It should be understood that swell packers 105 and 113 are examples of uses of the principles of the subject disclosure. Other types of packers may be constructed, and other types of annular barriers may be formed, without departing from the principles of the subject disclosure. An annular barrier could be formed in conjunction with production tubing, strings, casings, liners, sand-control screens, gravel pack assembly or casing hangers inside a casing or against a formation. Thus, the subject disclosure is not limited in any manner to the details of the well system 101 described herein.

Downhole swellable fixtures may comprise in non-limiting examples an elastomeric material filled with a setting or reactive filler such as cement clinker (silicates, aluminates and ferrites) and may further comprise oxides such as magnesium oxide and calcium oxide. The elastomeric material may be a relatively inert rubber e.g., Hydrogenated Nitrile Butadiene Rubber (HNBR) or an oil swellable rubber e.g. ethylene propylene diene Monomer (M-class) rubber (EPDM). These reactive fillers may be activated by a plurality of different triggering mechanisms, in non-limiting examples, oil/water, time or temperature and once activated increase elastomeric stiffness. These reactive or reinforcing fillers increase the volume of the elastomer/filler composite and through experimental data it has been determined that this increase in volume primarily comes from bound water and some unbound water. The unbound water is water diffusing into the elastomer/filler composite and bound water is water which hydrates the inorganic material. As a result, even after several days in a dry environment, the volume increase remains due to hydration and bound water. The volume increase may reach in non-limiting examples about 50%. Further, the volumetric swelling may be controlled in non-limiting examples, by modifying the total amount of fillers used or using more than one filler and in these instances the volumetric increase may reach greater than about 100%.

The use of swellable materials for sealing components requires control of the swelling kinetics. The downhole swellable fixture must be deployed in its correct position before it swells and seals. The elastomer/reactive filler composites allow control of the swelling kinetics by controlling the reaction kinetics of the one or plurality of fillers as well as the permeability of the elastomer to swelling fluid, for example, water or oil. Filler type, size, shape, concentration, porosity and chemical nature, and their combinations, as well as the chemical nature of the elastomer matrix can be used to control the reaction kinetics and consequently swelling kinetics of these composite materials.

Different particle filler size results in a variation in swelling of the downhole swellable fixtures. The rate at which cement hydrates varies with the cement particle size, specifically, larger cement particles require a greater amount of time to completely hydrate. The rubber matrix will also influence the diffusion rate of fluid which will affect the reaction kinetics of fillers. In one non limiting example, a reactive filler which reacts in the presence of water will have an increase in its reaction rate with a rubber matrix which facilitates faster diffusion of water and this in turn will increase the swelling rate of the rubber/filler composite.

Figure 2B:
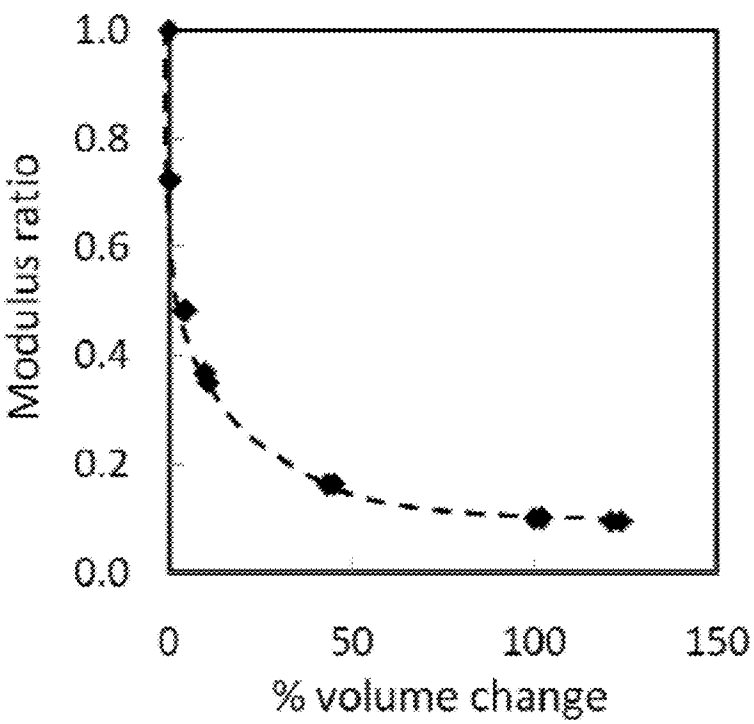
FIGS. 2A and 2B are graphs of volume change (%) and modulus ratio as a function of time for a typical oil swell material.
Figure 2A:
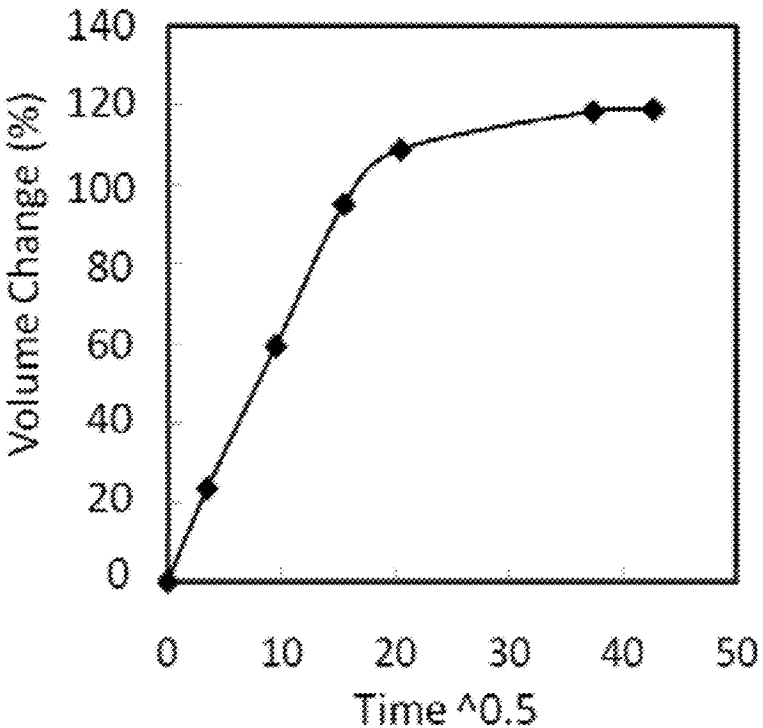

Conventional mechanical packers are generally composed of NBR (Nitrile Butadiene Rubber) or HNBR (Hydrogenated Nitrile Butadiene Rubber) with a reinforcing filler, for example, carbon black or silica. Conventional swell packers are generally composed of a swellable matrix, for example, ethylene propylene diene Monomer (M-class) rubber (EPDM) blends for oil swellable or swellable fillers, for example, Sodium Polyacrylate, Sodium Polyacrylamide or Clay for water swellables. The composition used for conventional packers may determine if the packer deswells if the solvent is not present anymore, for example, water in the case of water swellables. Also, the swollen material loses mechanical properties, therefore lowering the maximum differential pressure the swollen packer can withstand. FIGS. 2A and 2B show a conventional oil swellable material. The graphs are of volume change (%) and modulus ratio as a function of time for an oil swell material. Oil swellable elastomers swell by fluid absorption in the rubber matrix, and as can be seen in FIG. 2B their modulus tends to decrease as they swell and this affects the amount of differential pressure the packer is able to sustain after setting.

Embodiments of the subject disclosure relate to downhole swellable fixtures composed of a swellable matrix comprising a reactive filler which reinforces the swellable matrix after swelling or setting. Further, embodiments of the subject disclosure relate to downhole swellable fixtures composed of a swellable matrix which remains swollen after the swelling fluid is removed, for example, water. The swellable matrix disclosed in the subject disclosure may be used for sealing applications, for example, packers. The material is initially a compliant material. After the filler reacts, for example, the cement sets, the material becomes a stiffer and swollen material with hydration increasing volume.

Base Material

The base material of the seal is generally selected from any suitable material known in the industry for forming seals. Preferably, the base material is a polymer. More preferably, the base material is an elastomer. Elastomers that are particularly useful in the present invention include nitrile rubber (NBR), hydrogenated nitrile rubber (HNBR), carboxylated nitrile rubber (XNBR), carboxylated hydrogenated nitrile rubber (XHNBR), silicone rubber, ethylene-propylene-diene copolymer (EPDM), fluoroelastomer (FKM, FEPM) and perfluoroelastomer (FFKM), and any mixture or blends of the above. "Elastomer" as used herein is a generic term for substances emulating natural rubber in that they stretch under tension, have a high tensile strength, retract rapidly, and substantially recover their original dimensions. The term includes natural and man-made elastomers, and the elastomer may be a thermoplastic elastomer or a non-thermoplastic elastomer. The term includes blends (physical mixtures) of elastomers, as well as copolymers, terpolymers, and multipolymers.

Reactive Filler Material

A reactive filler material selected from the group consisting of a cement, cementitious material, metal oxide, and mixtures thereof react and swell upon contact with water and stiffen the composite at the same time. In non-limiting examples the metal oxide is magnesium oxide, calcium oxide, manganese oxide, nickel oxide, copper oxide, berillium oxide and mixtures thereof. In other non-limiting examples the reactive filler may be a suitable epoxy comprising an epoxy resin and a hardener (or curing agent) which may react (or polymerize) together over time or temperature. The epoxy may further contain a suitable diluent. Polymerization of epoxy is called "curing", and can be controlled through temperature and choice of resin and hardener compounds; the process can take minutes to hours. Some formulations benefit from heating during the cure period, whereas others simply require time, and ambient temperatures. Some common epoxy resins include but not limited to: the diglycidyl ether of bisphenol A (DGEBA), novolac resins, cycloaliphatic epoxy resins, brominated resins, epoxidized olefins, Epon® and Epikote®. Examples of hardeners include but not limited to: Aliphatic amines such as triethylenetetramine (TETA) and diethylenetriamine (DETA); Aromatic amines, including diaminodiphenyl sulfone (DDS) and dimethylaniline (DMA); Anhydrides such as phthalic anhydride and nadic methyl anhydride (NMA); Amine/phenol formaldehydes such as urea formaldehyde and melamine formaldehyde; Catalytic curing agents such as tertiary amines and boron trifluoride complexes. Diluents and solvents are used to dilute or thin epoxy resins. Some examples are: Glycidyl ethers (reactive diluents) such as n-butyl glycidyl ether (BGE), isopropyl glycidyl ether (IGE) and phenyl glycidyl ether (PGE); Organic solvents such as toluene (toluol), xylene (xylenol), acetone, methyl ethyl ketone (MEK), 1,1,1-trichloroethane (TCA), and glycol.

Figure 3A:
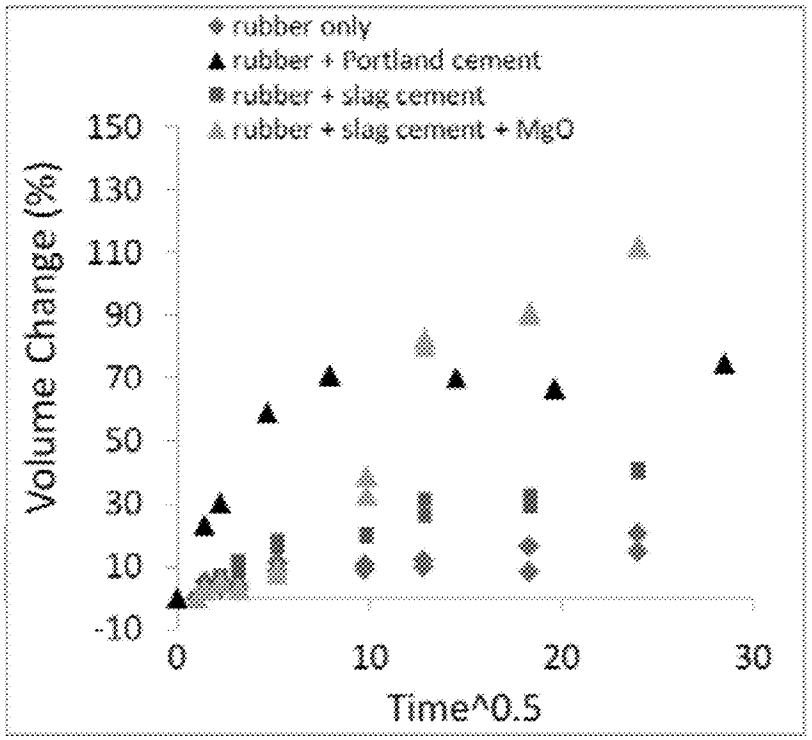
FIGS. 3A and 3B are graphs of volume change (%) and modulus ratio as a function of time for an improved water swelling compound described herein.
Figure 3B:
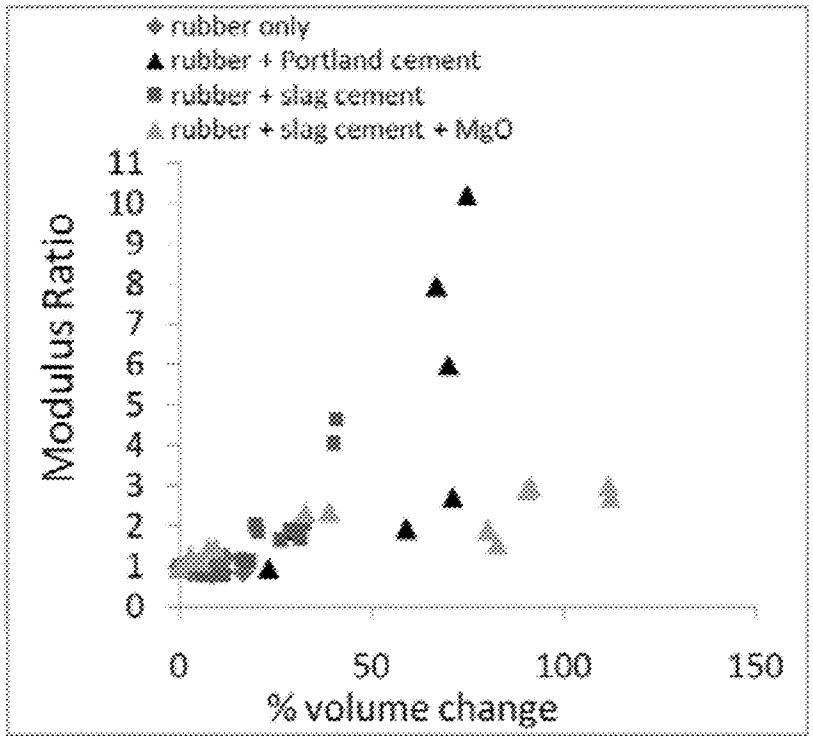

In non-limiting examples the cement is a Portland cement or a mixture of slag and Portland cement. Further examples include Portland cement blends, non-limiting examples include Portland blast furnace cement, Portland flyash cement, Portland pozzolan cement, Portland silica fume cement, masonry cements, expansive cements, white blended cements and very finely ground cements and mixtures thereof. Finally, non-Portland hydraulic cements may also be used, non-limiting examples include Pozzolan-lime cements, slag-lime cements, supersulfated cements, calcium aluminate cements, calcium sulfoaluminate cements and geopolymer cements. These filler materials improve the physical properties of the composition by acting as a reactive filler material. These fillers may impart many advantages to the composite materials produced from the formulations, such as increased volume and increased modulus. Embodiments of the subject disclosure relate to reactive fillers dispersed within a polymer matrix, wherein the reactive fillers swell on contact with water due to hydration and phase modification of the fillers upon reaction with a triggering fluid, in one non-limiting example, water. Reactive fillers in one non-limiting example are cement-like particles, about 1-50 microns, composed of Portland cement or a mixture of slag and Portland cement. FIGS. 3A and 3B are graphs of volume change (%) and modulus ratio as a function of time for an improved water swelling compound described herein. The novel water swelling compounds show an increase in modulus with swelling. FIG. 3A compares the volume change (%) with time for a pure rubber sample and samples containing Portland cement or a mixture of slag and Portland cement or a mixture of slag, Portland cement and MgO. The pure rubber sample has a volume change (%) of about ~10%. The samples with Portland cement or a mixture of slag and Portland cement respectively swell to ratios of about ~70% and ~30%. Finally, the sample with cement and MgO swells to about 110%. FIG. 3B shows the increase in modulus of each of the samples. The pure rubber sample maintains the same modulus ratio over time. The rubber and Portland cement sample increases its modulus by a factor 10 over time. There is also an increase in the modulus ratio of samples containing rubber and a mixture of slag and Portland cement or rubber and a mixture of slag, Portland cement and MgO. MgO and other suitable oxides hydrate upon exposure to an aqueous fluid, in a non-limiting example, to an aqueous fluid during production. The hydration products of suitable oxides are less dense; therefore; there is a corresponding volume increase when they react with an aqueous fluid, e.g., water. Other suitable oxides include CaO, MnO, NiO, BeO and CuO and combinations thereof.

Manufacturing the Elastomeric Samples

The elastomeric compositions useful in downhole swellable fixtures of the subject disclosure may be readily made using conventional rubber mixing techniques e.g. using an internal rubber mixer (such as mixers manufactured by Banburry) and/or a twin roll mill (such as mills manufactured by PPlast). In non-limiting examples cement powder is added to rubber gum during mixing. Other materials such as Magnesium Oxide (MgO) or Super Absorbent Polymers (SAP) may also be added.

Superabsorbent Polymers (SAP) or Hydrogels

Recently there has been a growing interest in swellable elastomers for use in oilfield applications. In order to make elastomers swell in water, previous publications have disclosed elastomer formulations that contain superabsorbent polymers like hydrogels (See U.S. Pat. No. 7,373,991, entitled "Swellable Elastomer-based apparatus, oilfield elements comprising same, and methods of using same in oilfield applications", filed Mar. 27, 2006). The main drawback of using hydrogels is that hydrogel containing swellable polymers do not possess long term physical integrity. This is because the hydrogel particles embedded in the elastomer tends to migrate to the surface of the elastomer part and into the water phase. As a result, elastomer/hydrogel blends show a nonuniform swelling and develop blisters on the surface when exposed to water. After a few days of exposure to water these blisters burst open and hydrogel particles are ejected out of the blend leaving behind cracks in the elastomer.

Water swellable packers often incorporate hydrophillic, swelling polymers (sometimes referred to as "superabsorbing particles" for example, cationic, anionic or zwitterionic polymers in an elastomeric matrix. Non-limiting examples include Polyacrylic acid, polymethacrylic acid, polyacrylamide, polyethyleneoxide, polyethylene glycol, polypropylene oxide, poly(acrylic acid-co-acrylamide), polymers made from zwitterionic monomers which includeN, N-dimethyl-N-acryloyloxyethyl-N-(3-sulfopropyl)-ammonium betaine, N,N-dimethyl-N-acrylamidopropyl-N-(2-carboxymethyl)-ammonium betaine, N,N-dimethyl-N-acrylamidopropyl-N-(3-sulfopropyl)-ammonium betaine, 2-(methylthio)ethyl methacryloyl-S-(sulfopropyl)-sulfonium betaine, 2-[(2-acryloylethyl)dimethylammonio]ethyl 2-methyl phosphate, [(2-acryloylethyl)dimethylammonio]methyl phosphonic acid, 2-(acryloyloxyethyl)-2'-(trimethylammonium)ethyl phosphate, 2-methacryloyloxyethyl phosphorylcholine, 2-[(3-acrylamidopropyl)dimethylammonio]ethyl 2'-isopropyl phosphate, 1-vinyl-3-(3-sulfopropyl)imidazolium hydroxide, (2-acryloxyethyl)carboxymethyl methylsulfonium chloride, 1-(3-sulfopropyl)-2-vinylpyridinium betaine, N-(4-sulfobutyl)-N-methyl-N,N-diallylamine ammonium betaine, N,N-diallyl-N-methyl-N-(2-sulfoethyl)ammonium betaine and the like. Superabsorbent polymers are hydrophilic networks which can absorb and retain huge amounts of water or aqueous solutions. These superabsorbing materials exhibit very fast kinetics of swelling which is useful for sealing applications. However, as discussed above these materials do not possess long term physical integrity. Further, a large amount of SAP fillers are often required (~30-40% by weight of the composite) to achieve swelling, resulting in a significant strength reduction upon swelling. A further limiting aspect of SAP materials is sensitivity to salt concentration, tending to deswell upon exposure to brine which results in loss of zonal isolation.

The present disclosure further relates to an embodiment of a downhole fixture comprising elastomeric material compounded with reactive fillers and SAP for use in swellable fixtures. The advantages of this embodiment are that SAP will absorb a large quantity of water and this water will then be available to the reactive fillers, thereby increasing the reaction rate and hence the swelling rate of the reactive fillers. The reactive fillers provide both swelling and reinforcement to the material thus providing long term physical integrity. Further, the amount of SAP needed is reduced as the SAP functions mainly for initial water uptake and the reactive filler provides the swelling.

Embodiments of the subject disclosure comprising elastomers and reactive fillers have a slower rate of swelling when compared to oil swellable elastomers. To improve the efficiency of water transport SAP may be used. Rubber compositions containing SAP fillers have often been used in the past to make water swellable packers. See commonly owned, U.S. Pat. No. 7,373,991, entitled "Swellable elastomer-based apparatus, oilfield elements comprising same, and methods of using same in oilfield applications", filed Mar. 27, 2006, the contents of which are herein incorporated by reference.

Figure 4A:
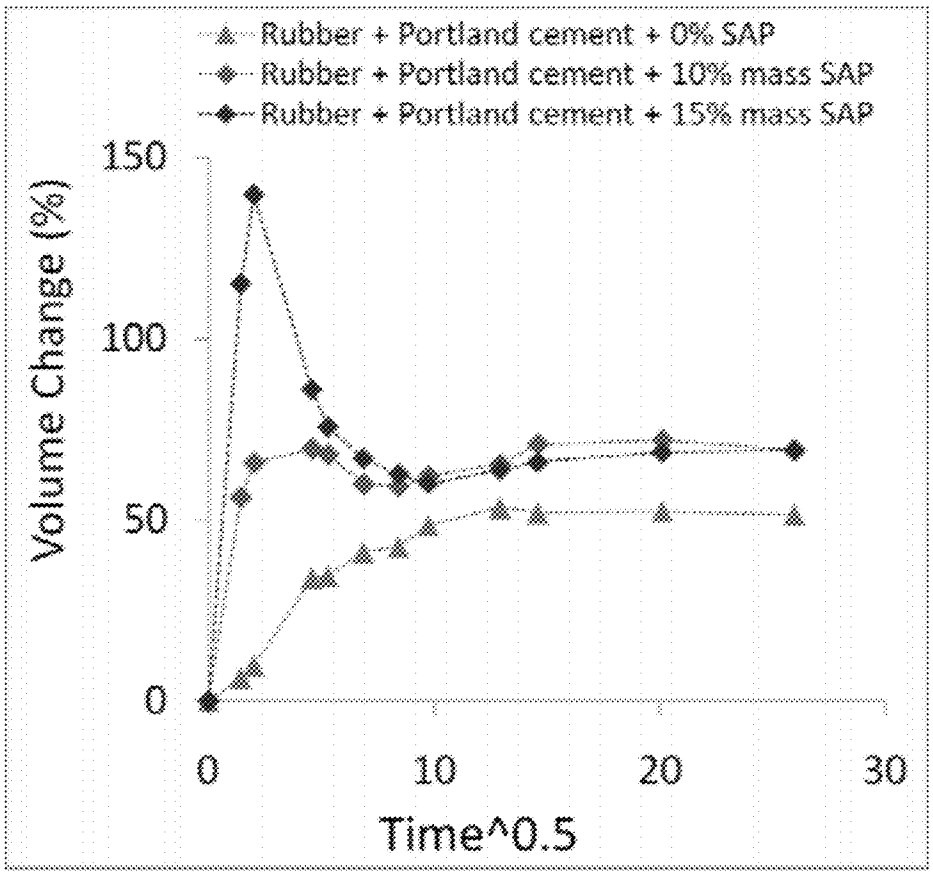
FIGS. 4A and 4B are graphs of volume change (%) and modulus ratio as a function of time for an improved water swelling compound described herein containing superabsorbent polymer (SAP) at two different concentrations: 10% mass SAP and 15% mass SAP.
Figure 4B:
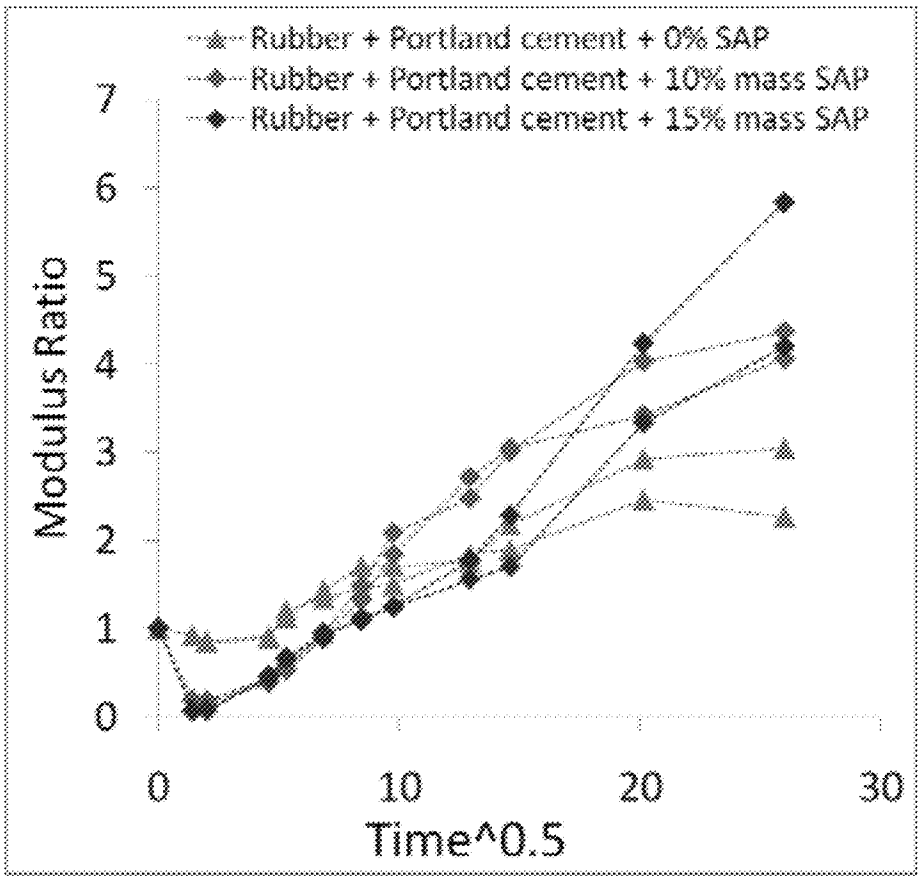

Embodiments of the subject disclosure disclose elastomeric compositions suitable for downhole swelling fixtures comprising reactive fillers and a small percentage of SAP. FIGS. 4A and 4B are graphs of volume change (%) and modulus ratio as a function of time for an improved water swelling compound for use in downhole fixtures described herein containing superabsorbent polymer (SAP) in addition to cement at two different concentrations: 10% mass SAP and 15% mass SAP. The samples swell rapidly especially in the first few hours due to the addition of SAP and the ability of SAP to absorb a large amount of water. The greater the amount of SAP added initially the higher the swelling ratio in the first few hours. The sample with about 15% of SAP swells to about 140% versus the sample with 10% which swells to about 60%. However, after some time, the swelling ratio of the samples decreases to equilibrium of about 50%-60% similar to the sample with no SAP added. The addition of SAP results in a significant increase in the volume of rubber even at very short durations. Volume increase is a result of the rapid absorption of water by SAP. SAP also is a water source for cement hydration resulting in faster hydration of cement. FIG. 4B shows the modulus increase with varying amounts of SAP. The modulus of samples containing SAP reduces significantly in the first few hours from an initial modulus of about 1 to as low as 0. The modulus increases again over time and the sample containing the highest amount of SAP (15%) has the highest percentage modulus increase of about 500% or by a factor of about 6. The increased availability of water inside the rubber matrix increases the rate of cement hydration, thus, increasing the modulus of the rubber matrix. The addition of SAP increases both the kinetics of swelling and stiffening upon incorporation of SAP to embodiments of the subject disclosure. Further, the rubber matrix is reinforced which is a significant advantage compared to rubber matrices containing only SAP which become soft upon swelling and therefore results in failure of the material under a high differential load.

Figure 5:
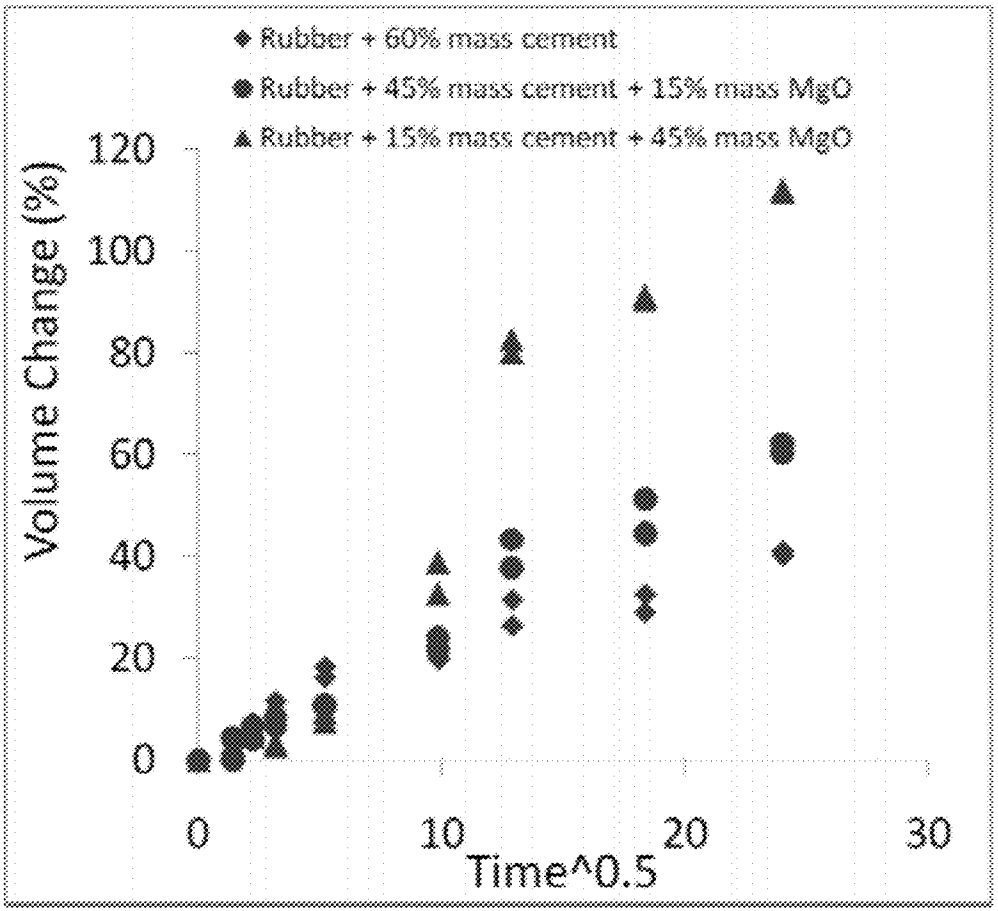
FIG. 5 illustrates a graph of volume change (%) as a function of time for an improved water swelling compound described herein containing Magnesium oxide (MgO) at two different concentrations: 15% mass MgO and 45% mass MgO.

FIG. 5 illustrates a graph of volume change (%) as a function of time for an improved water swelling compound for use in downhole fixtures described herein containing magnesium oxide (MgO) at two different concentrations: 15% mass MgO and 45% mass MgO. An increase in MgO compounded with cement increases the amount of swelling. The sample with 45% MgO has a volume change (%) of about 110% versus the sample with 15% MgO having a volume change of about 60%.

Figure 6:
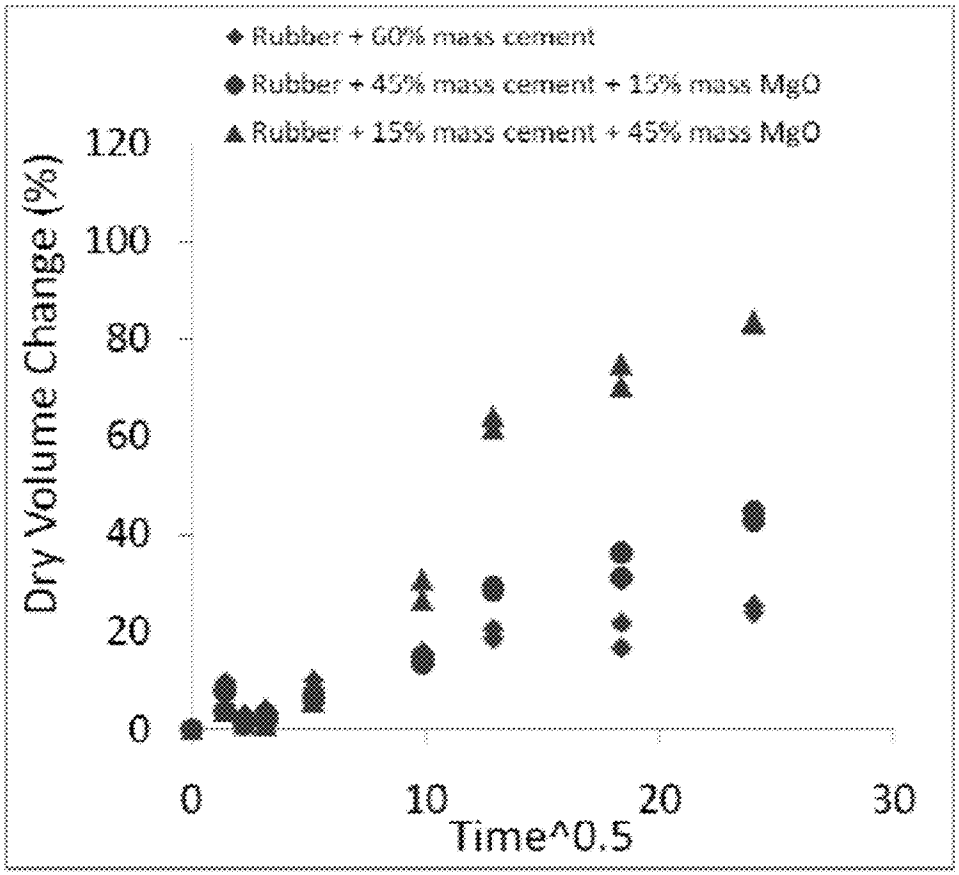
FIG. 6 illustrates a graph of % dry volume change as a function of time for an improved water swelling compound described herein containing Magnesium oxide (MgO) at two different concentrations: 15% mass MgO and 45% mass MgO. Dry volume means that samples were exposed to water for varying times as illustrated on the graph and then dried by exposure to air at 82° C.

FIG. 6 illustrates a graph of % dry volume change as a function of time for an improved water swelling compound for use in downhole fixtures described herein containing magnesium oxide (MgO) at two different concentrations: 15% mass MgO and 45% mass MgO. Samples were exposed to water for varying times as illustrated on the graph and then dried by exposure to air at 82° C. The samples remained partially swollen after drying with a volume change (%) of about 80% for the sample containing 45% MgO.

Figure 7:
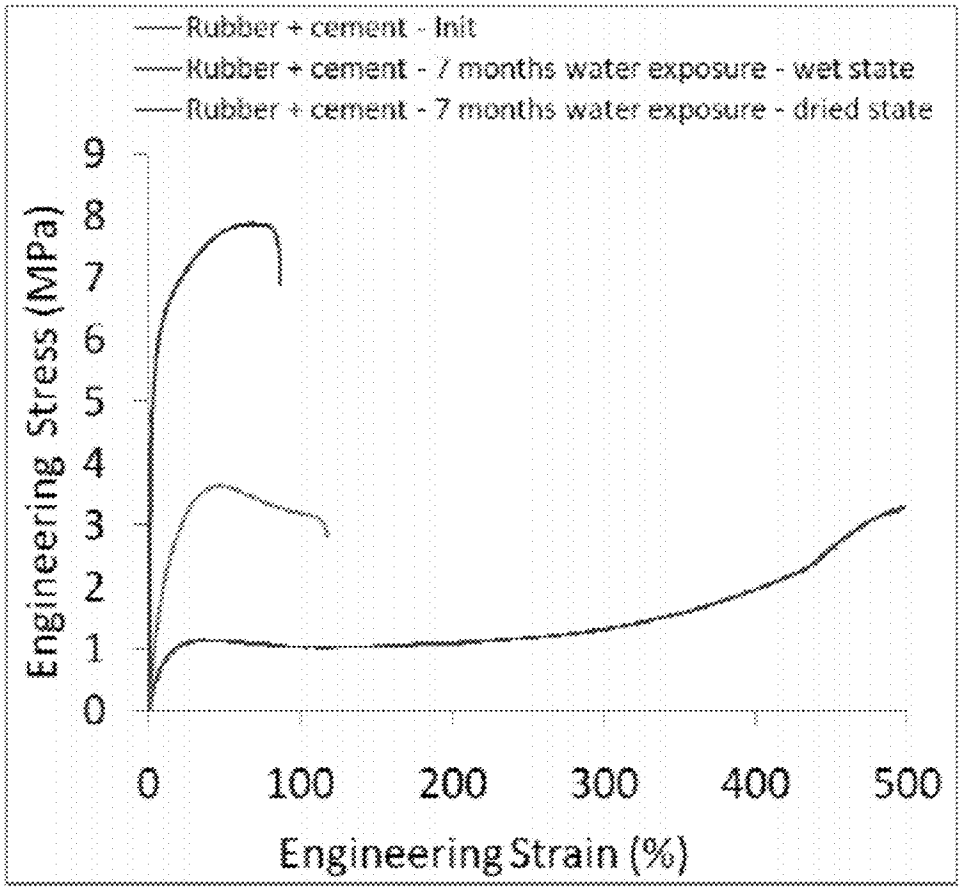
FIG. 7 is a stress-strain graph for an improved swelling compound according to exemplary embodiments of the present invention.

FIG. 7 is a stress-strain graph for an improved swelling compound for use in downhole fixtures described herein according to exemplary embodiments of the present invention. The rubber/cement composite exhibits a large increase in strength after drying.

Brine Insensitive Water Swellable Polymers

Embodiments of the subject disclosure may need to swell in the presence of brine. As used herein, the term "brine" is meant to refer to any water-based fluid containing alkaline or earth-alkaline chlorides salt such as sodium chloride, calcium chloride, etc, sulphates and carbonates. The swelling characteristics may be variable in relation to the variability in salt concentration of the brine. That is, as the salt concentration increases, the amount of swell will also increase. It is important to have a seal whose swelling is less sensitive to the changes in brine concentration. The elastomer backbone of embodiments of the subject disclosure may be tailored with particular concentrations of cations and/or anions grafted thereto so as to reduce the sensitivity thereof to brine concentration. Materials may be used that swell to a given degree upon exposure to brine in the well. Additionally, the given degree of swell for the material remains substantially constant where the brine concentration fluctuates. Embodiments of the subject disclosure disclose a swellable fixture, in one non-limiting example a packer configured of brine-insensitive materials combined with reactive fillers.

Packer Seal Test Experiment

A mini-packer of an oil swellable material and a mini-packer of HNBR rubber, cement and MgO in varying percentages were tested and compared using methods known to those skilled in the art. The oil swellable packer failed at a differential pressure of about 1,200 psi and major material extrusion which is related to poor mechanical properties was observed. The novel water swellable packer failed at a differential pressure of 11,000 psi and minor material extrusion which is related to good mechanical properties was observed.

Figure 8A:
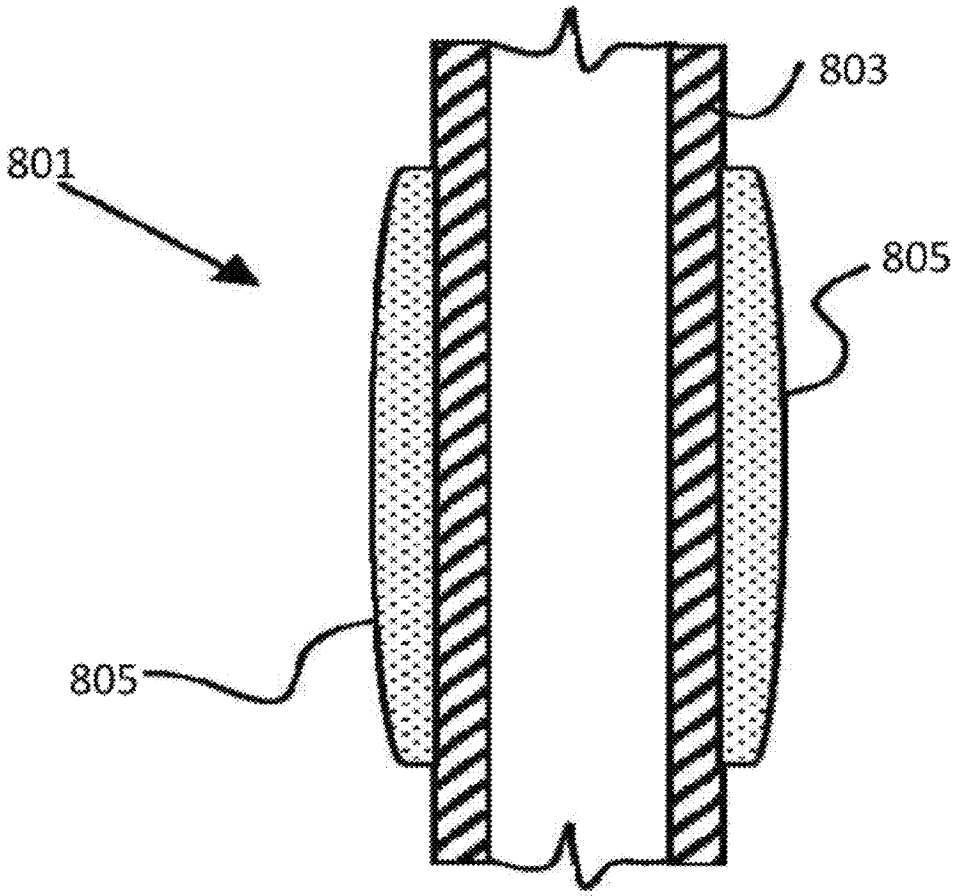
FIG. 8A is a schematic, cross-section view of a downhole tool with a deployable sealing element (a water swellable elastomer as described herein) in its initial shape.
Figure 8B:
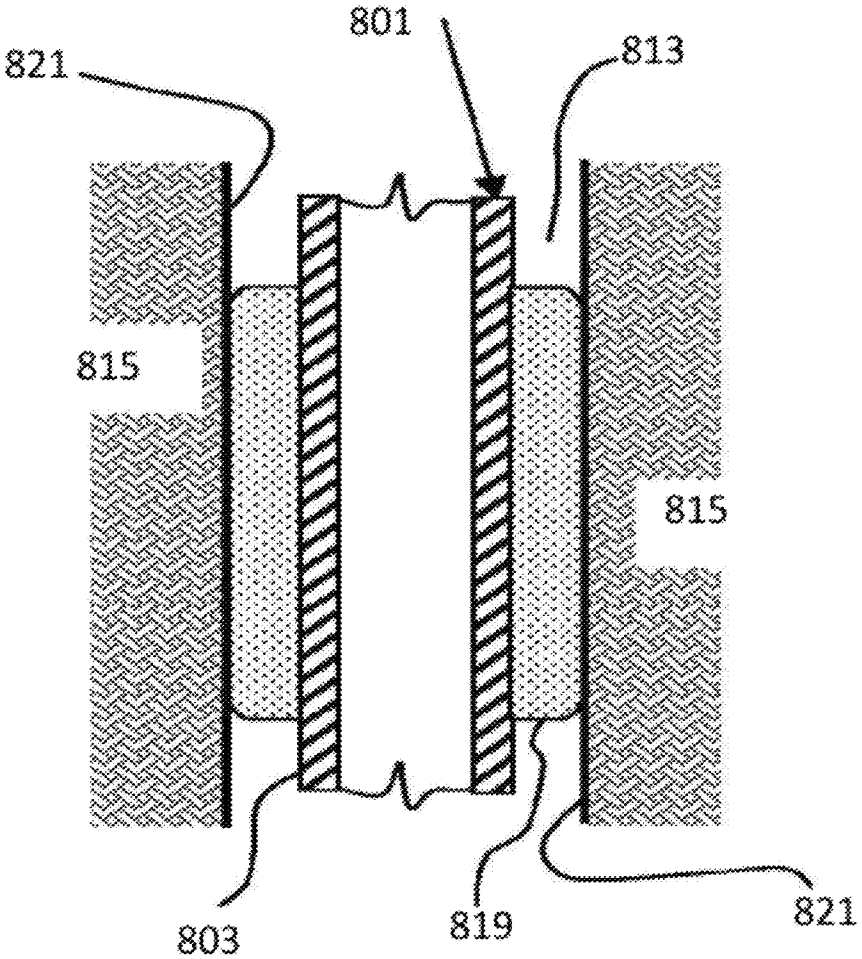
FIG. 8B is a schematic, cross-section view of the downhole tool of FIG. 8A where the selectively deployable sealing element has been deployed.

An example of using the water swellable elastomers described herein on a downhole tool 801, in a specific case a packer, is schematically illustrated in FIGS. 8A and 8B. FIG. 8A shows the sealing assembly 805 which comprises a seal assembly of the subject disclosure in a first or initial compliant state which has formed around a tubing 803. The first or initial compliant state allows the downhole tool to be put in the correct place easily. After contact with water or brine, the sealing assembly 805 will expand, swell to a second less compliant state or volume 819, and will then conform to the borehole wall 821 of the subterranean formation 815. In this manner, wellbore 813 is sealed.

While the subject disclosure is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A sealing system for use in a subterranean wellbore, comprising a seal assembly wherein the seal assembly comprises:

a base polymer; and one or a plurality of reactive fillers combined with the base polymer, the one or a plurality of reactive fillers comprising a metal oxide;

wherein the seal assembly is compliant before contacting a triggering fluid and increases from a first volume to a second volume and becomes less compliant in response to contact with the triggering fluid.

2. The sealing system of claim 1 wherein the second volume does not decrease to the first volume in response to termination of contact with the triggering fluid.

3. The sealing system of claim 1 wherein the seal assembly has a modulus increase from the first volume to the second volume.

4. The sealing system of claim 3 wherein the modulus increase is by a factor of one or more.

5. The sealing system of claim 1 wherein a rate of increase from a first volume to a second volume is controlled by selection of one or more of a reactive filler type, a particle size and a concentration of the one or a plurality of reactive fillers.

6. The sealing system of claim 1 wherein a rate of increase from a first volume to a second volume is controlled by selection of the base polymer.

7. The sealing system of claim 1 wherein the one or a plurality of reactive fillers is a reinforcing reactive filler.

8. The sealing system of claim 7 wherein the reinforcing reactive filler is a cement or a cementitious material.

9. The sealing system of 8 wherein the cement is selected from the group consisting of Portland cement, a mixture of slag and Portland cement, Portland cement blends, Non-Portland hydraulic cements, or a mixture thereof.

10. The sealing system of claim 1 wherein the base polymer is an elastomeric material.

11. The sealing system of claim 10 wherein the elastomeric material comprises a rubber material.

12. The sealing system of claim 11 wherein the rubber material is selected from the group consisting of nitrile rubber, nitrile butadiene rubber, carboxylated nitrile butadiene rubber, hydrogenated nitrile butadiene rubber, carboxylated hydrogenated nitrile butadiene rubber, hydrogenated acrylonitrile-butadiene rubber, ethylene propylene diene M-class rubber; fluoroelastomer (FKM, FEPM) and perfluoroelastomer (FFKM), and mixtures or blends thereof.

13. The sealing system of claim 10 wherein the elastomeric material swells upon contact with the triggering fluid due to absorption of the triggering fluid by the elastomeric material.

14. The sealing system of claim 13 wherein the triggering fluid is a wellbore fluid.

15. The sealing system of claim 14 wherein the wellbore fluid is water and/or hydrocarbons.

16. The sealing system of claim 1 wherein the metal oxide comprises magnesium oxide, calcium oxide, manganese oxide, nickel oxide, copper oxide, berillium oxide and mixtures thereof.

17. The sealing system of claim 1 wherein the one or a plurality of reactive fillers comprises an epoxy.

18. The sealing system of claim 1 wherein the sealing system has improved mechanical properties after contact with the triggering fluid.

19. The sealing system of claim 1 for use as a cement replacement.

20. The sealing system of claim 1 for use with a production tubing, strings, casings, liners, sand-control screens, gravel pack assembly or casing hangers inside a casing or against a formation.

21. The sealing system of claim 1 further comprising a superabsorbent polymer.

22. The sealing system of claim 21, comprising about 10% to about 50% of the superabsorbent polymer.

23. The sealing system of claim 22 wherein the superabsorbent polymer does not decrease a modulus of the seal assembly.

24. The sealing system of claim 1 further comprising a material configured of reduced sensitivity to brine.

25. The sealing system of claim 24 wherein the material has tailored concentrations of one of cations and anions.

26. The sealing system of claim 25 where the material swelling remains unchanged upon exposure to brine wellbore fluids.

27. The sealing system of claim 1 wherein the sealing assembly is adapted to form a permanent seal in the wellbore.

28. The sealing system of claim 1 wherein the sealing system is an annular seal configured to seal an annulus between the sealing system and the wellbore.

29. A method for forming a seal in a wellbore comprising:

providing a composition comprising (a) a plurality of reactive fillers comprising at least one metal oxide and (b) a base material;

deploying the composition into the wellbore; and exposing the composition to a triggering fluid, thereby forming a seal in the wellbore;

whereby the seal isolates a particular wellbore zone from another wellbore zone or region of a subterranean formation and wherein the seal formed is an o-ring, a packer element, a flow control valve or a bridge plug.

30. The method of claim 29 further comprising positioning the seal around a slotted sleeve, a slotted liner or a sand control screen.

31. A sealing system for use in a subterranean wellbore, comprising:

a swellable material wherein the swellable material comprises;

a base polymer;

a reinforcing reactive filler disposed in the base polymer;

a material configured of reduced sensitivity to brine;

wherein the swellable material swells when in contact with a triggering fluid; and the swellable material is a compliant material having a first volume before swelling with the triggering fluid and is a less compliant material having a second volume after swelling with the triggering fluid.

32. The sealing system of claim 31 further comprising magnesium oxide.

33. The sealing system of claim 32 wherein the swellable material has a volume of about 180% of the first volume after drying the swellable material.

34. A method of forming an annular barrier in a subterranean wellbore, the method comprising the steps of:

compounding one or a plurality of a reactive materials within a base polymer to thereby form a compliant seal assembly, the one or a plurality of reactive fillers comprising a metal oxide; and the compliant seal assembly contacting a triggering fluid and increasing from a first volume to a second volume and becoming less compliant in response to contact with a triggering fluid, and wherein the compliant seal assembly does not decrease to the first volume in response to termination of contact with the triggering fluid.

35. The method of claim 34 wherein the one or a plurality of reactive fillers in the compounding step is a cement material.

36. A method of constructing a well packer, the method comprising the steps of:

compounding one or a plurality of reactive materials within a base polymer to thereby form a compliant well packer, the one or a plurality of reactive fillers comprising a metal oxide;

installing the compliant well packer on a base pipe;

the compliant well packer contacting a triggering fluid and increasing from a first volume to a second volume and becoming less compliant in response to contact with a triggering fluid, and wherein the compliant well packer does not decrease to the first volume in response to termination of contact with the triggering fluid.

37. A swellable packer construction, comprising:

a seal assembly including one or a plurality of compounded reactive materials within a base polymer, the one or a plurality of reactive fillers comprising a metal oxide; the seal assembly being swellable in response to contact with well fluid in a well.

38. A seal for use in a borehole the seal comprising:

a compounded reactive material within a base polymer that is capable of expanding or swelling upon contact with a triggering fluid;

a material configured of reduced sensitivity to brine; and wherein the seal is an annular seal configured to seal an annulus in a wellbore.

* * * * *